US012702160B2

(12) United States Patent
Crawford

(10) Patent No.: US 12,702,160 B2
(45) Date of Patent: Aug. 11, 2026

(54) PORTABLE HUMIDOR

(71) Applicant: Timothy Crawford, Burleson, TX (US)

(72) Inventor: Timothy Crawford, Burleson, TX (US)

( * ) Notice: Subject to any disclaimer, the term of this patent is extended or adjusted under 35 U.S.C. 154(b) by 2 days.

(21) Appl. No.: 18/883,101

(22) Filed: Sep. 12, 2024

(65) Prior Publication Data

US 2025/0089764 A1 Mar. 20, 2025

Related U.S. Application Data

(60) Provisional application No. 63/582,845, filed on Sep. 14, 2023.

(51) Int. Cl.

| | |
|---|---|
| ***A24F 13/00*** | (2006.01) |
| ***A24F 15/18*** | (2006.01) |
| ***A24F 25/02*** | (2006.01) |
| ***B65D 51/24*** | (2006.01) |
| ***B65D 81/22*** | (2006.01) |

(52) U.S. Cl.

CPC ..... *A24F 25/02* (2013.01); *A24F 15/18* (2013.01); *B65D 51/24* (2013.01); *B65D 81/22* (2013.01)

(58) Field of Classification Search

CPC ..... A24F 25/02; A24F 15/18; A24F 13/18; A24F 1/28; A24F 13/16; A24F 13/12; A24F 13/14; A24F 15/12; A24F 19/0064; A24F 13/02; B65D 51/24; B65D 81/22; B65D 85/12; B65D 85/1009; B65D 85/1045; B65D 85/10

USPC ..... 206/242, 249; 131/175, 256

See application file for complete search history.

(56) References Cited

U.S. PATENT DOCUMENTS

| | | | | |
|---|---|---|---|---|
| 6,463,936 | B1 * | 10/2002 | Hicks | A24F 13/18 131/194 |
| 11,013,259 | B2 * | 5/2021 | Nguyen | A24F 15/18 |
| 2009/0255933 | A1 * | 10/2009 | Zeyfang | B65D 59/04 220/375 |
| 2021/0204596 | A1 * | 7/2021 | Miller | A24F 15/18 |

* cited by examiner

*Primary Examiner* — King M Chu

(57) ABSTRACT

A portable humidor includes a body portion having a first end and a second end and an interior surface. A first cap is attachable to the first end of the tube portion and a second cap is attachable to the second end of the body portion. A stub is affixed to the interior surface, wherein the stub is configured to retain a sheet receivable proximate the interior surface. Other embodiments are disclosed.

20 Claims, 6 Drawing Sheets

PORTABLE HUMIDOR

This application claims priority to United States provisional application 63/582,845 for PORTABLE HUMIDORS filed on Sep. 14, 2023, which is reference for all that is disclosed therein.

FIELD

The present disclosure relates to portable humidors.

BACKGROUND

Cigars contain rolled tobacco that is best used in cigars when the tobacco is kept humid. If cigars dry out, they burn hot and fast, which diminishes their flavor. When people are on a golf course or other location, they may want to smoke a cigar. However, from the time a cigar smoker leaves his residence until he lights a cigar away from their residence, the cigar may have dried out. Therefore, a need exists for a portable humidor.

DETAILED DESCRIPTION

Figure 1:
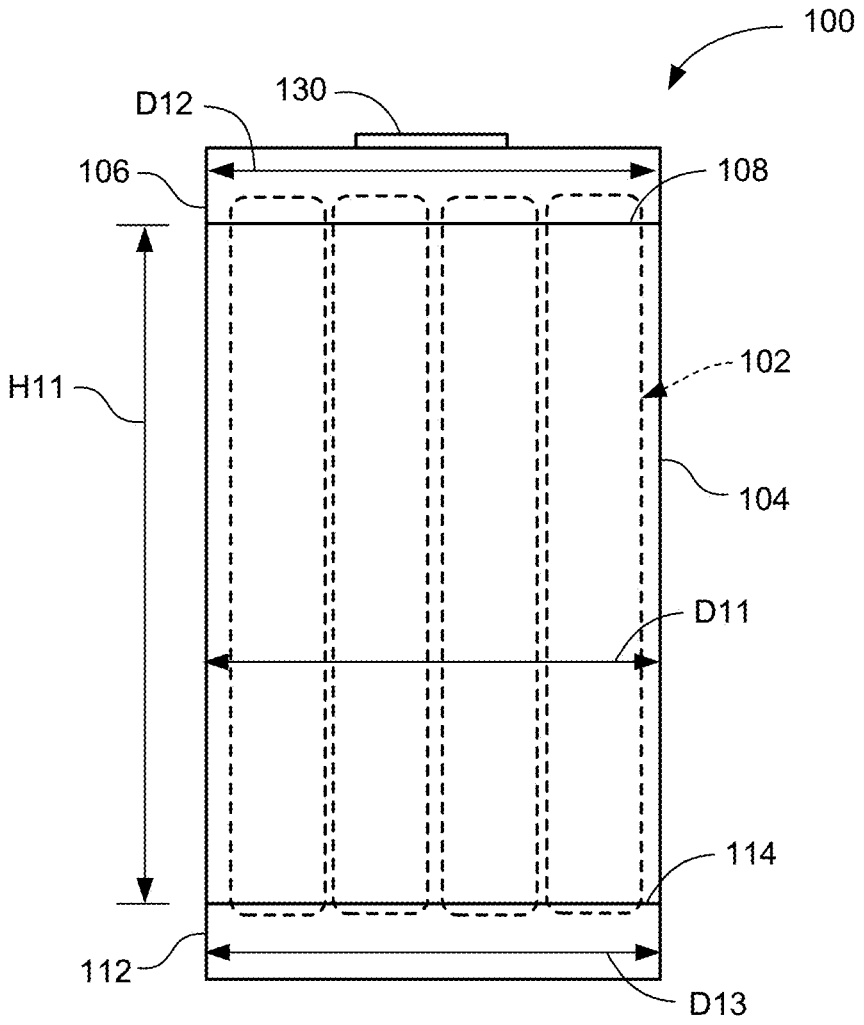
FIG. 1 illustrates a side elevation view of a portable humidor having a top cap and a bottom cap secured to a body portion according to embodiments described herein.
Figure 2:
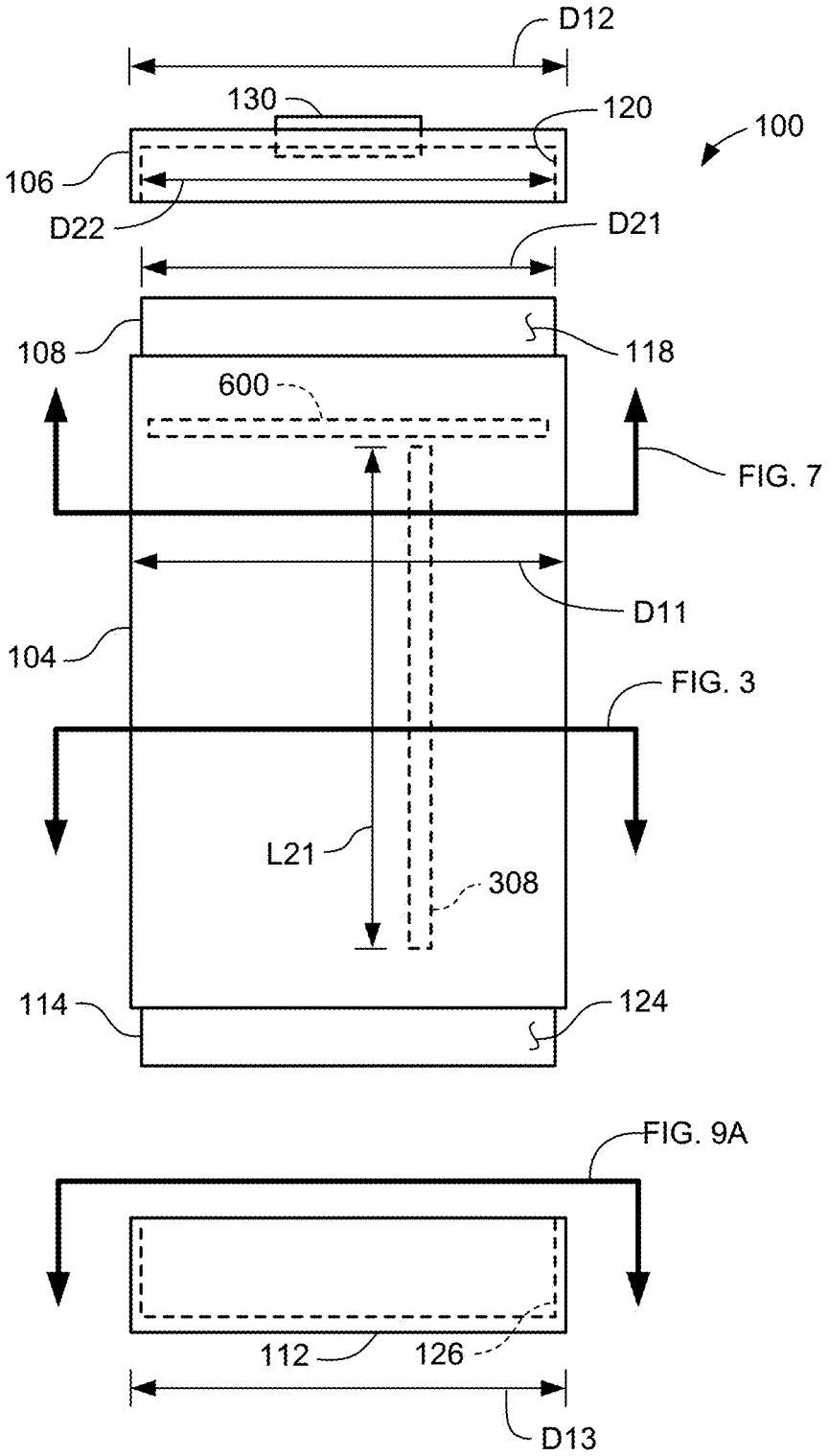
FIG. 2 illustrates an exploded view of the portable humidor of FIG. 1 with the top cap and the bottom cap removed from the body portion according to embodiments described herein.

Reference is made to FIG. 1, which illustrates a side elevation view of a portable humidor 100 configured to hold one or more cigars 102. Reference is also made to FIG. 2, which is an exploded view of the portable humidor of FIG. 1. The portable humidor 100 includes a body portion 104 that is configured to receive the cigars 102. A top cap 106 may be configured to be removably affixed to a top side 108 of the body portion 104. A bottom cap 112 may be configured to be removably affixed to a bottom side 114 of the body portion 104. The body portion 104 has a height H11 that may depend on the lengths of the cigars 102 that are configured to be placed into the portable humidor 100.

The body portion 104 has an exterior diameter D11, that may be wide enough to hold one or more cigars 102. The top cap 106 has an exterior diameter D12. In some embodiments, the diameter D11 and the diameter D12 may be equal. In other embodiments, the diameter D12 may be greater than the diameter D11. The bottom cap 112 has an exterior diameter D13. In some embodiments, the diameter D11 and the diameter D13 may be equal. In other embodiments, the diameter D13 may be greater than the diameter D11.

The top side 108 may have an exterior surface 118 that has a diameter D21 (FIG. 2) that may be slightly smaller than the diameter D11 of the body portion 104. In some embodiments, the top side 108 may have a diameter D21 that is the same size as the diameter D11 so that the top cap 106 extends over the exterior of the body portion 104. The top side 108 may have an exterior surface 118 that may be threaded. The top cap 106 may have an interior surface 120 having a diameter D22.

The interior surface 120 may be configured to contact the exterior surface 118. This contact may removably secure the top cap 106 to the body portion 104. In some embodiments, friction between the exterior surface 118 and the interior surface 120 may removably secure the top cap 106 to the body portion 104. In other embodiments, the exterior surface 118 and the interior surface 120 may have threads that enable the top cap 106 to be screwed onto the top side 108 of the body portion 104. When the top cap 106 is secured to the body portion 104 water vapor (e.g., humidity) may be prevented from escaping between the body portion 104 and the top cap 106.

The bottom side 114 may have an exterior surface 124 that may be similar to the exterior surface 118. The bottom cap 112 may have an interior surface 126 that is configured to contact the exterior surface 124. This contact may removably secure the bottom cap 112 to the body portion 104. In some embodiments, friction between the exterior surface 124 and the interior surface 126 may removably secure the bottom cap 112 to the body portion 104. In other embodiments, the exterior surface 124 and the interior surface 126 may have threads that enable the bottom cap 112 to be screwed onto the bottom side 114 of the body portion 104. When the bottom cap 112 is secured to the body portion 104 water vapor (e.g., humidity) may be prevented from escaping between the body portion 104 and the bottom cap 112.

The top cap 106 may have a humidity gauge 130 at least partially extending into the interior of the body portion 104. The exterior side of the humidity gauge 130 may have indicia readable by a user that indicates the humidity (e.g., relative humidity) of the interior of the body portion 104. The indicia may, as examples, be digital displays and gauges. Thus, the humidity gauge 130 indicates the humidity in which the cigars 102 are stored.

Figure 3:
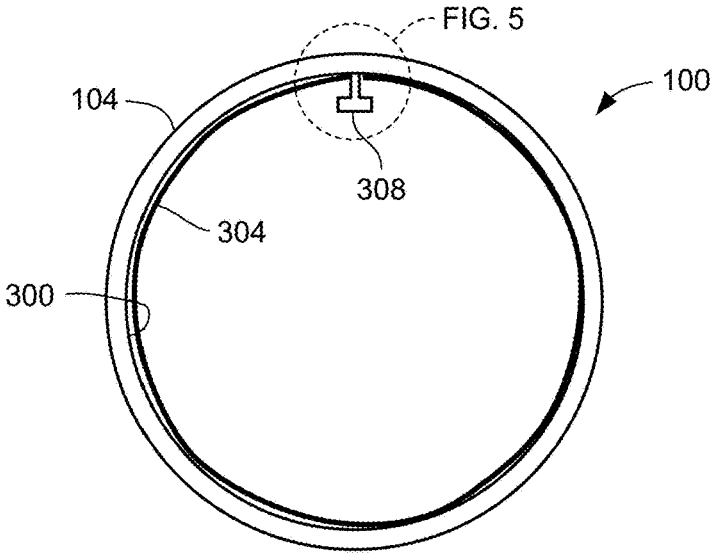
FIG. 3 illustrates a cutaway plan view of the body portion of the portable humidor of FIG. 1 according to embodiments described herein.

Additional reference is made to FIG. 3, which is a cross sectional view of the body portion 104. The body portion 104 may have an interior surface 300 having a circumference. The body portion 104 may be configured to hold a sheet 304 proximate the interior surface of the body portion 104. The sheet 304 is shown in cross section in FIG. 3 as a dark line. The sheet 304 may be a partially rigid material such as a thin sheet of wood or a sheet of paper. The sheet 304 may be scented such that the scent may be transferred to the cigars 102. For example, the sheet 304 may be a sheet of cedar wood. A stub 308 may extend from the interior surface 300. The stub 308 may have a length L21 as shown in FIG. 2. In some embodiments, the stub 308 may be shorter and in other embodiments, the stub 308 may include several short portions.

Figure 4:
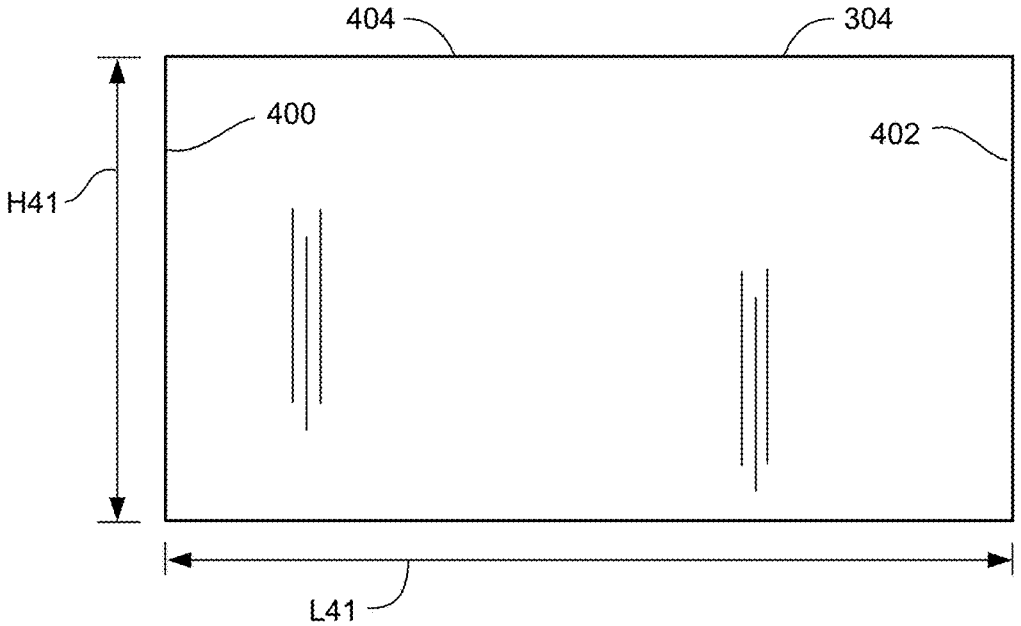
FIG. 4 illustrates an elevation view of a sheet that may be located in the portable humidor of FIG. 1 according to embodiments described herein.

Additional reference is made to FIG. 4, which is a plan view of an embodiment of the sheet 304. The sheet has a height H41, which, in some embodiments may be less than the height H11 (FIG. 1) of the body portion 104. The height H41 being less than the height H11 enables the sheet 304 to be located in the body portion 104 without interfering with the top cap 106 or the bottom cap 112. The sheet 304 has a length L41 extending between a first end 400 and a second end 402. The length L41 may be slightly less than the circumference of the interior surface 300. The length L41 enables the sheet 304 to remain in a fixed position relative to the body portion 104 as described herein.

Figure 5:
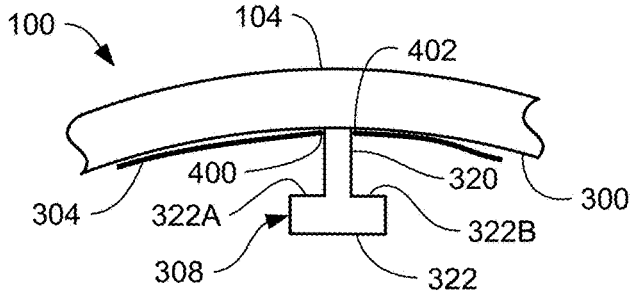
FIG. 5 illustrates an enlarged view of a stub of FIG. 3 located in the body portion according to embodiments described herein.

Reference is made to FIGS. 2-4. The stub 308 may extend from the interior surface 300 toward the center of the body portion 104. As shown in FIGS. 3 and 5, the stub 308 may be T-shaped when viewed from the top side 108 or the bottom side 114 of the body portion 104. The stub 308 may extend the length L21 (FIG. 2) along at least a portion of the length of the interior surface 300. The stub 308 is shown extending as a single component. In other embodiments, the stub 308 may comprise a plurality of individual components, such as a plurality of short stubs. For example, a first stub portion may be located proximate the top side 108 and a second stub portion may be located proximate the bottom side 114.

The stub 308 may have an extension member 320 and a cross member 322. The cross member 322 may have a first portion 322A and a second portion 322B that extend from the extension member 320. The extension member 320 may retain the sheet 304 stationary relative to the interior surface 300 as the portable humidor 100 is moved and/or as the cigars 102 are placed into and are removed from the body portion 104. The cross member 322 may retain the first end 400 and the second end 402 of the sheet 304 adjacent the interior surface 300. For example, the first portion 322A and the second portion 322B may keep the first end 400 and the second end 402 of the sheet 304 from rolling or moving into the interior of the body portion 104.

The length L41 plus the width of the extension member 320 may be approximately equal to the circumference of the interior surface 300. In some embodiments, the length L41 plus the width of the extension member 320 may be slightly less than the circumference of the interior surface 300. The length of the first portion 322A and the length of the second portion 322B enable the length L41 to be shorter than the length of the circumference of the interior surface 300 minus the width of the extension member 320 while maintaining the sheet 304 in a fixed location relative to the body portion 104.

Figure 6:
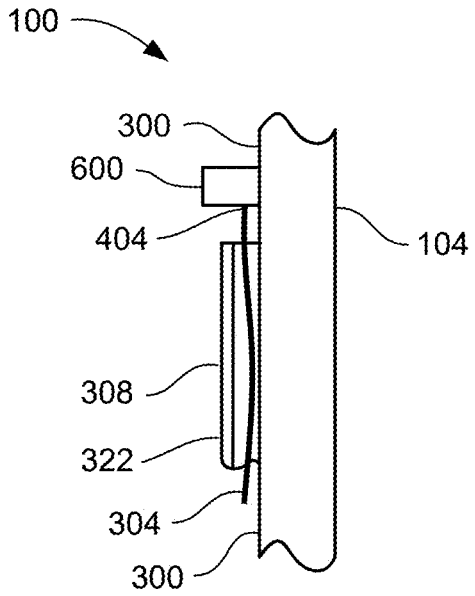
FIG. 6 illustrates a partial cutaway side view of the body portion of the portable humidor of FIG. 1 including a stub and a circumferential ring according to embodiments described herein.
Figure 7:
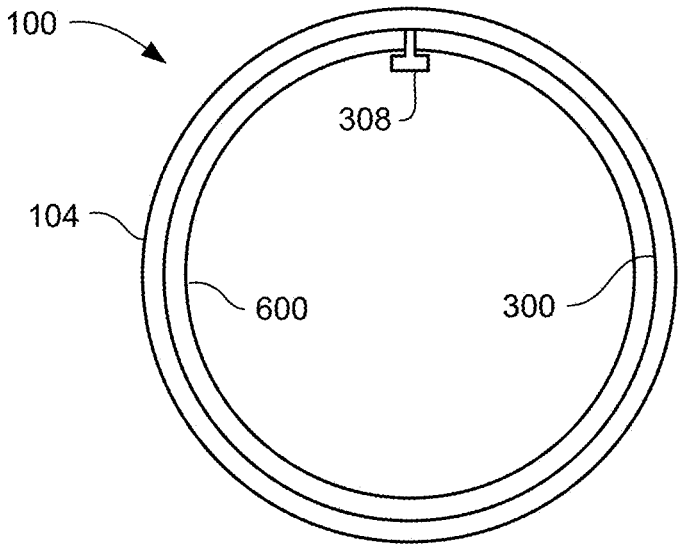
FIG. 7 illustrates a cutaway end view of the body portion of the portable humidor of FIG. 2 including a stub and a circumferential ring according to one or more embodiments.

Additional reference is made to FIGS. 6 and 7, which illustrate a circumferential ring 600 that may be located adjacent or attached to the interior surface 300 of the body portion 104. FIG. 6 illustrates a partially cutaway side view of the body portion 104 including the stub 308 and the circumferential ring 600. FIG. 7 illustrates a cutaway end view of the body portion 104 including the stub 308 and the circumferential ring 600. FIG. 6 shows a side view cutaway view of the sheet 304 beneath the cross member 322 of the stub 308 and abutting the circumferential ring 600. When the sheet 304 abuts the circumferential ring 600 the sheet 304 is prevented from moving out of the body portion 104 by way of the top side 108. In addition, when the sheet 304 abuts the circumferential ring 600, the cigars 102 (FIG. 1) will not contact the top edge 404 of the sheet 304 as the cigars 102 are placed into the body portion 104. Thus, the insertion of the cigars 102 will not dislodge the sheet 304.

Figure 8:
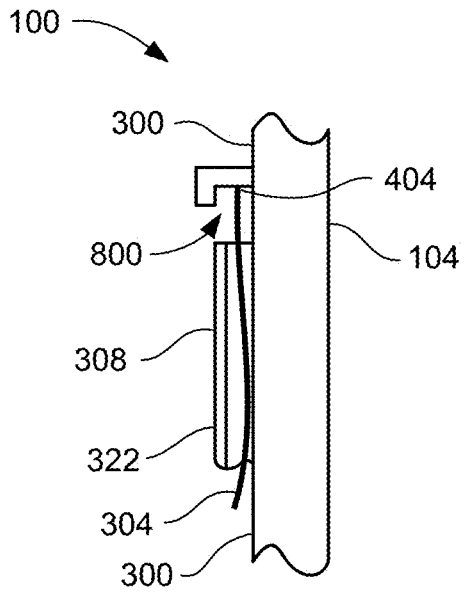
FIG. 8 illustrates a partial cutaway side view of the body portion of the portable humidor of FIG. 1 including a stub and a circumferential ring having a notch formed therein according to embodiments described herein.

FIG. 8 illustrates the view of FIG. 6 wherein the circumferential ring 600 has a notch 800 configured to receive the top edge 404 of the sheet 304. The notch 800 may further retain the sheet 304 proximate the interior surface 300 of the body portion 104 to better retain the sheet 304 and prevent the cigars 102 (FIG. 1) from interfering with the sheet 304. In some embodiments, the circumferential ring 600 may be located proximate the bottom side 114 of the body portion 104.

The portable humidor 100 may include a carrier or the like configured to store vapor or humidity releasing devices, such as humidity beads. The humidity beads may maintain the interior of the portable humidor 100 and, thus, the cigars 102 at a preselected relative humidity. Additional reference is made to FIG. 9A, which is a top plan view of an embodiment of the bottom cap 112 configured to hold humidity beads 900 (a few labelled). The bottom cap 112 may be configured to hold humidity devices other than the humidity beads 900. Additional reference is also made to FIG. 9B, which illustrates an elevation cutaway view of the bottom cap 112 of FIG. 9A.

The bottom cap 112 may have a chamber 906 formed in part by a platform 908. The chamber 906 is configured to hold the humidity beads 900 and may also be configured to support the cigars 102 (FIG. 1) in the body portion 104 (FIG. 1). The platform 908 may have a vented cap 910 configured to enable the humid air generated by the humidity beads 900 to pass into the body portion 104. The vented cap 910 may be replaceable so that a user may replace the humidity beads 900. The vented cap 910 may be held in place in the platform 908 by friction, threads, or other securing methods. The chamber 906 may also be formed into the top cap 106.

Figure 9A:
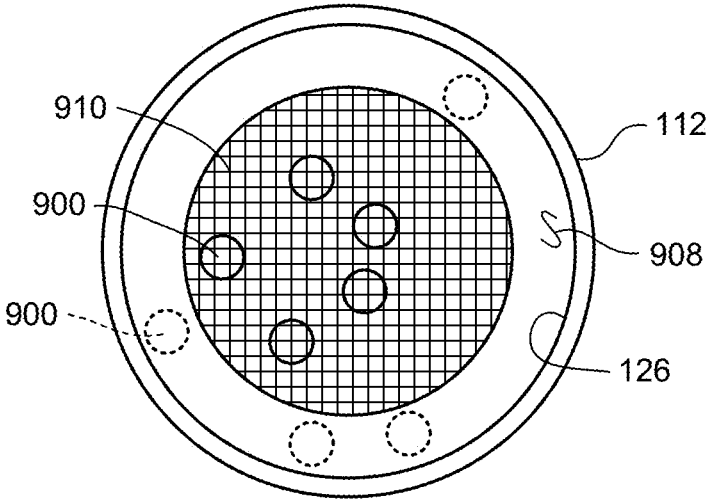
FIG. 9A illustrates a top plan view of an embodiment of the bottom cap of FIG. 2 configured to hold humidity devices according to embodiments described herein.
Figure 9B:
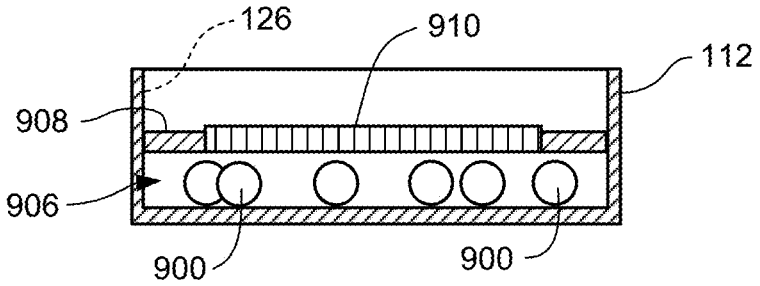
FIG. 9B illustrates an elevation cutaway view of the bottom cap of FIG. 9A according to embodiments described herein.
Figure 10A:
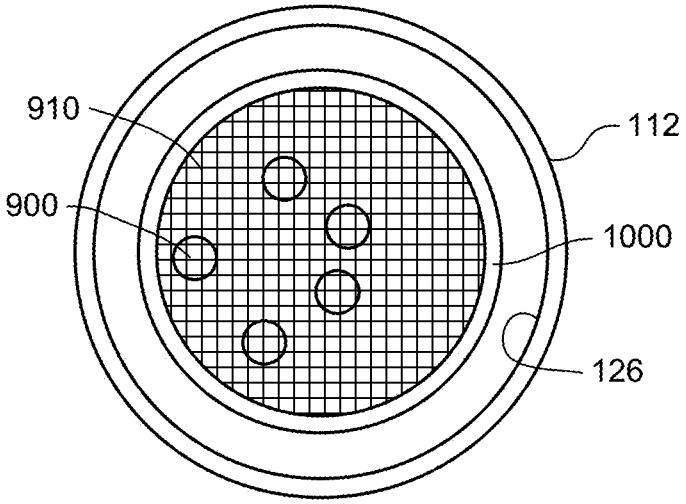
FIG. 10A illustrates a top plan view of another embodiment of the bottom cap of FIG. 2 configured to hold humidity devices according to embodiments described herein.
Figure 10B:
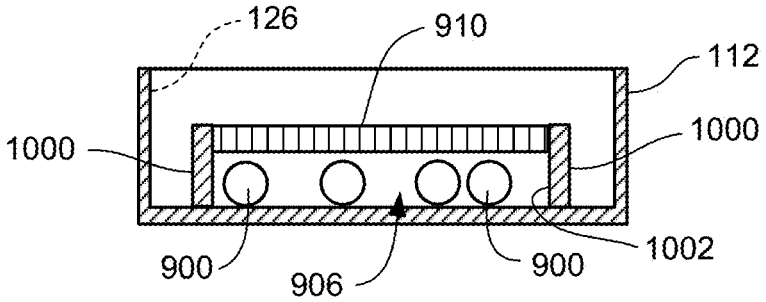
FIG. 10B illustrates an elevation cutaway view of the bottom cap of FIG. 10A according to embodiments described herein.

Additional reference is made to FIGS. 10A and 10B, which are variations to the embodiments of the bottom cap 112 of FIGS. 9A and 9B. In the embodiments of FIGS. 10A and 10B, the chamber 906 may be formed at least partially by a wall 1000. The wall 1000 may be circular and may be configured to have the vented cap 910 attached to the wall 1000. In the embodiment of FIGS. 10A and 10B, the vented cap 910 may be received by an inner surface 1002 of the wall 1000. Friction or other forces or mechanisms may secure the vented cover the wall 1000.

Figure 11:
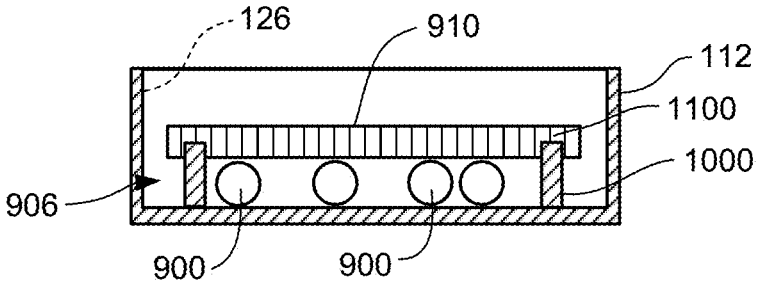
FIG. 11 illustrates an elevation cutaway view of another embodiment of the bottom cap of FIG. 10A according to embodiments described herein.

FIG. 11 illustrates another embodiment of the bottom cap 112 wherein the vented cap 910 extends at least partially over the wall 1000. The vented cap 910 may have a groove 1100 or the like formed therein that receives a portion of the wall 1000. Friction or other mechanisms may secure the vented cover to the wall.

In use, a user may remove the bottom cap 112. The user may then open or remove the vented cap 910 and place the humidity beads 900 into the chamber 906. The user may also insert the sheet 304 into the body portion 104. The sheet may abut the stub 308 and the circumferential ring 600. Stiffness of the sheet 304 may retain the sheet 304 against the interior surface 300 of the body portion 104. The user may then replace the bottom cap 112 onto the body portion 104. The portable humidor will not have humidity provided by the humidity beads 900 and a scent provided by the sheet 304.

The user may then remove the top cap 106 from the body portion 104 and place the cigars 102 into the body portion 104. As the cigars are placed into the body portion 104, the circumferential ring 600 may prevent the cigars 102 from interfering with the sheet 304. The humidity gauge 130 will indicate the relative humidity of the body portion 104. If the humidity gauge indicates that the air in the body portion 104 is dry, the user may replace the humidity beads 900.

What is claimed is:

1. A portable humidor comprising:

a body portion having a first end and a second end and an interior surface, wherein the body portion is configured to receive a plurality of cigars;

a first cap attachable to the first end of the body portion;

a second cap attachable to the second end of the body portion; and a stub affixed to the interior surface, wherein the stub is configured to retain a sheet receivable proximate the interior surface.

2. The portable humidor of claim 1, wherein the body portion is at least partially cylindrical.

3. The portable humidor of claim 1, wherein the stub includes an extension member extending radially from the interior surface, the extension member configured to contact an edge of the sheet.

4. The portable humidor of claim 3, wherein the extension member extends axially in a direction between the first end and the second end of the body portion.

5. The portable humidor of claim 3, further comprising a cross member extending perpendicular in a first direction relative to the extension member.

6. The portable humidor of claim 5, wherein the cross member is configured to contact an edge of a sheet located proximate the interior surface.

7. The portable humidor of claim 3, further comprising a cross member extending perpendicular in a first direction and an opposite second direction relative to the extension member.

8. The portable humidor of claim 1, further comprising a circumferential ring extending inwardly at least partially on the interior surface, wherein the circumferential ring is configured to contact an edge of a sheet located proximate the interior surface.

9. The portable humidor of claim 8, wherein the circumferential ring includes an edge member forming a notch configured to receive an edge of the sheet.

10. The portable humidor of claim 1, further comprising a chamber located in the first cap, wherein humidity devices are receivable in the chamber.

11. The portable humidor of claim 10, further comprising a vented cover covering a portion of the chamber and facing into the body portion.

12. The portable humidor of claim 11, wherein the vented cover is removable from the first cap.

13. The portable humidor of claim 11, wherein the vented cover is retained to the first cap by friction.

14. A portable humidor comprising:

a body portion having a first end and a second end and an interior surface, wherein the body portion is configured to receive a plurality of cigars;

a first cap attachable to the first end of the body portion;

a second cap attachable to the second end of the body portion;

a sheet located proximate the interior surface; and a stub affixed to the interior surface, wherein the stub retains the sheet proximate the interior surface.

15. The portable humidor of claim 14, wherein the stub includes an extension member extending radially from the interior surface, the extension member contacting an edge of the sheet.

16. The portable humidor of claim 15, wherein the extension member extends axially in a direction between the first end and the second end of the body portion.

17. The portable humidor of claim 15, further comprising a cross member extending perpendicular relative to the extension member, wherein the cross member contacts an edge of the sheet.

18. The portable humidor of claim 1, further comprising a circumferential ring extending inwardly at least partially on the interior surface, wherein an edge of the sheet contacts at least a portion of the circumferential ring.

19. The portable humidor of claim 1, further comprising a chamber located in the first cap, wherein humidity devices are receivable in the chamber.

20. A portable humidor comprising:

a body portion having a first end and a second end and an interior surface, wherein the body portion is configured to receive a plurality of cigars;

a first cap attachable to the first end of the body portion;

a second cap attachable to the second end of the body portion;

a sheet located proximate over half the interior surface;

a stub affixed to the interior surface, wherein the stub retains the sheet proximate the interior surface; and a vented cover covering a portion of the chamber, wherein the vented cover is removable from the first cap.

* * * * *